US007520725B1

(12) United States Patent
Liang

(10) Patent No.: US 7,520,725 B1
(45) Date of Patent: Apr. 21, 2009

(54) TURBINE AIRFOIL WITH NEAR-WALL LEADING EDGE MULTI-HOLES COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 404 days.

(21) Appl. No.: 11/503,576

(22) Filed: Aug. 11, 2006

(51) Int. Cl.
*F01D 5/18* (2006.01)

(52) U.S. Cl. ..... 416/97 R

(58) Field of Classification Search ..... 415/115; 416/97 R

See application file for complete search history.

(56) References Cited

U.S. PATENT DOCUMENTS 4,505,639 A 3/1985 Groess et al.
4,859,147 A 8/1989 Hall et al.
5,356,265 A * 10/1994 Kercher ..... 416/97 R
5,667,359 A 9/1997 Huber et al.
5,720,431 A * 2/1998 Sellers et al. ..... 416/97 R
6,099,251 A 8/2000 LaFleur
6,164,912 A 12/2000 Tabbita et al.
6,168,381 B1 1/2001 Reddy
6,183,198 B1 * 2/2001 Manning et al. ..... 416/97 R
6,264,428 B1 7/2001 Dailey et al.
6,379,118 B2 4/2002 Lutum et al.
6,533,547 B2 3/2003 Ading
6,634,859 B2 10/2003 Weigand et al.
6,994,521 B2 2/2006 Lang
7,011,502 B2 3/2006 Lee et al.

* cited by examiner

*Primary Examiner*—Ninh H Nguyen
(74) *Attorney, Agent, or Firm*—John Ryznic

(57) ABSTRACT

An air cooled airfoil used in a gas turbine engine includes a showerhead arrangement to cool the leading edge. A cooling supply cavity supplies cooling air to the airfoil, and is metered into an impingement cavity through at least one metering hole from the cooling supply cavity. A plurality of second impingement cavities are located between the first impingement cavity and the leading edge, and each second impingement cavity includes at least one second metering hole to meter cooling air into the second impingement cavity. Each second impingement cavity includes a plurality of film cooling holes to discharge cooling air to the leading edge surface of the airfoil. The second impingement cavities are located adjacent to each other, with one on the leading edge, another on the pressure side, and the third on the suction side.

6 Claims, 1 Drawing Sheet

TURBINE AIRFOIL WITH NEAR-WALL LEADING EDGE MULTI-HOLES COOLING

BACKGROUND OF THE INVENTION

1. Field of the Invention

The present invention relates generally to fluid reaction surfaces and more specifically to turbine airfoils with film cooling.

2. Description of the Related Art Including Information Disclosed Under 37 CFR 1.97 and 1.98

A gas turbine engine includes a turbine section in which a hot gas flow passes through the rotor blades and stationary vanes or nozzles to extract energy from the flow. The efficiency of the gas turbine engine can be increased by providing a higher flow temperature into the turbine. However, the temperature is limited to the material capabilities of the parts exposed to the hot gas flow.

One method of allowing for higher turbine temperatures is to provide cooling of the first and second stages of the turbine. Complex internal cooling passages have been disclosed to provide high cooling capabilities while using lower flow volumes of cooling air. Since the cooling air used in the turbine airfoils is typically bleed off air from the compressor, using less bleed off air for cooling also increases the efficiency of the engine.

A Prior Art airfoil leading edge is cooled with backside impingement in conjunction with a showerhead film cooling and is shown in FIG. 1. The airfoil 10 includes a cooling air supply cavity 22, a metering hole 23 connecting the supply cavity 22 to an impingement cavity 24, and a plurality of impingement holes 27 to discharge cooling air to the leading edge surface of the airfoil 10. a mid-chord three-pass forward flowing serpentine cooling circuit includes a first leg channel 40, a second leg channel 36, and a third leg channel 34. Film cooling holes 35 deliver cooing air to the suction side and film cooling holes 37 deliver cooling air to the pressure side from the third leg channel 34. Turbulators 50 are positioned along the walls of the channels and cavity to promote heat transfer to the cooling air. A trailing edge cooling slots 42 and cooling air exit holes 44 discharge cooling air from the first leg channel 40 to the trailing edge of the airfoil.

The showerhead film rows are fed cooling air from a common cooling supply cavity 22 and discharged at various gas side pressures. The pressure at each of the gas side locations can vary substantially as the hot gas flow accelerates around the nose of the leading edge. The minimum pressure ratio across the showerhead holes 27 is typically set by back-flow margin requirements, and the pressure ratio (and flow) across all of the other film cooling rows becomes substantially a function of the gas-side pressure. Backflow occurs when the pressure of the hot gas flow outside the leading edge is higher than the cooling air pressure inside the cooling supply cavity 24, resulting in the hot gas flowing into the inside of the airfoil. As a result of this cooling design, the cooling flow distribution and pressure ratio across the showerhead film holes 27 for the pressure side and suction side film row is predetermined by the supply pressure.

U.S. Pat. No. 7,011,502 B2 issued to Lee et al on Mar. 14, 2006 entitled THERMAL SHIELD TURBINE AIRFOIL. Discloses an airfoil with a longitudinal first inlet channel (56 in this patent) connected by a row of impingement holes (48 in this patent) to a longitudinal channel (42 in this patent), being connected by a plurality of film cooling holes (50 in this patent) to the leading edge surface of the airfoil. In the Lee et al patent, the longitudinal channel is also connected to bridge channels on the pressure side and suction sides of the longitudinal channel. Only one multi-impingement channel is used in the Lee et al invention to supply film cooling holes as opposed to the three separate multi-impingement channels of the present invention.

U.S. Pat. No. 4,859,147 issued to Hall et al on Aug. 22, 1989 entitled COOLED GAS TURBINE BLADE discloses an airfoil with a showerhead arrangement having a cooling air supply cavity (24 in this patent), an impingement cavity (28 in this patent) connected to the cooling supply cavity by three slots (26 in this patent), and three film cooling holes (30 in this patent) connected to the impingement cavity.

U.S. Pat. No. 6,379,118 B2 issued to Lutum et al on Apr. 30, 2002 entitled COOLED BLADE FOR A GAS TURBINE discloses a similar showerhead arrangement to that above of the Hall et al patent. A cooling air supply cavity (50 in this patent) is connected to an impingement cavity (47 in this patent) through two impingement cooling holes (49 in this patent), and three film cooling holes (48 in this patent) are connected to the impingement cavity. Both of the Hall et al and Lutum et al patents lack the first impingement cavity and the second impingement cavity in series, and the multi-impingement cavities of the present invention.

It is an object of the present invention to alleviate the problem associated with the turbine airfoil leading edge showerhead pressure ration or blowing ratio of the prior art. Another object of the present invention is to improve the efficiency of a gas turbine engine by providing improved cooling for the leading edge region of the airfoil.

BRIEF SUMMARY OF THE INVENTION

The present invention is a turbine airfoil having a showerhead film cooling holes arrangement to cool the leading edge, a cooling supply channel to supply cooling air, an impingement cavity connected to the supply cavity through a metering hole, and a plurality of multi-impingement cavities positioned between the showerhead film cooling holes and the impingement cavity, with multi-metering holes used to regulate the cooling air flow.

Cooling air is supplied through the leading edge cooling supply cavity and impinges onto the backside of the airfoil leading edge inner surface. This firstly provides impingement cooling of the airfoil leading edge section. Multiple metering holes are then used for each individual impingement cavity to provide a desired pressure and flow rate to the intermediate coolant pressure cavity. Multiple impingement cavities can be used in the spanwise direction for tailoring the blade spanwise hot gas side pressure and heat load conditions. In addition, the multiple metering holes also provide backside impingement cooling to the airfoil leading edge region at much closer distance to the airfoil exterior hot surface. Internal cooling pressure for each individual impingement cavity can also be regulated by the multiple metering holes. With the use of the cooling design of the present invention, a reduction of the overall pressure ratio across the leading edge film cooling holes can be achieved. At a given cooling flow rate and lower pressure ration across the film holes, it yields a large number of leading edge film holes thus forming a multi-hole cooling mechanism for the airfoil leading edge.

The advantages of the present invention over the prior art showerhead arrangement are numerous and include the following. The airfoil leading edge showerhead cooling flow and pressure are regulated in the blade chordwise and spanwise directions. Maximize the usage of the cooling air for a given airfoil inlet gas temperature and pressure profile is achieved. Increase number of leading edge film cooling holes will increase the leading edge film coverage. This translates to a better film effectiveness and lower leading edge metal temperature. Increase number of leading edge film cooling holes also increases the overall leading edge internal convection cooling capability and consequently reduces the blade leading edge metal temperature. Leading edge impingement cooling at reduced distance will lower the airfoil leading edge metal temperature. Lower the pressure ratio or blowing ratio across the showerhead film holes will minimize the coolant penetration into the gas path, yielding a good buildup of coolant sub-boundary layer next to the airfoil surface. This translates into higher leading edge film effectiveness and a lower metal temperature.

DETAILED DESCRIPTION OF THE INVENTION

Figure 1:
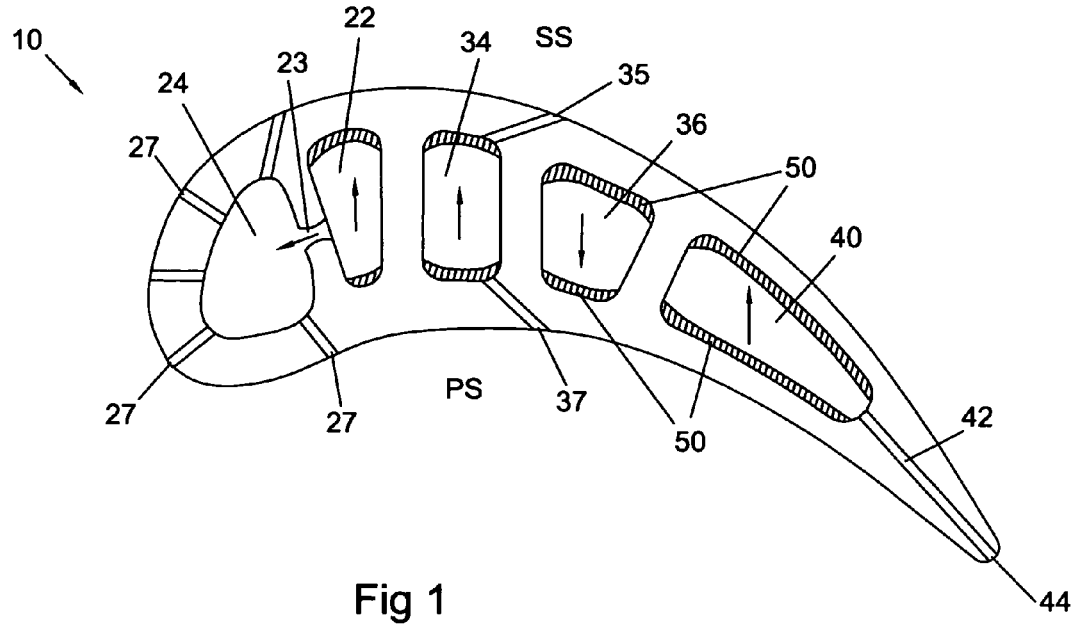
Fig 1 Prior Art
FIG. 1 shows a prior art airfoil with a showerhead arrangement.
Figure 2:
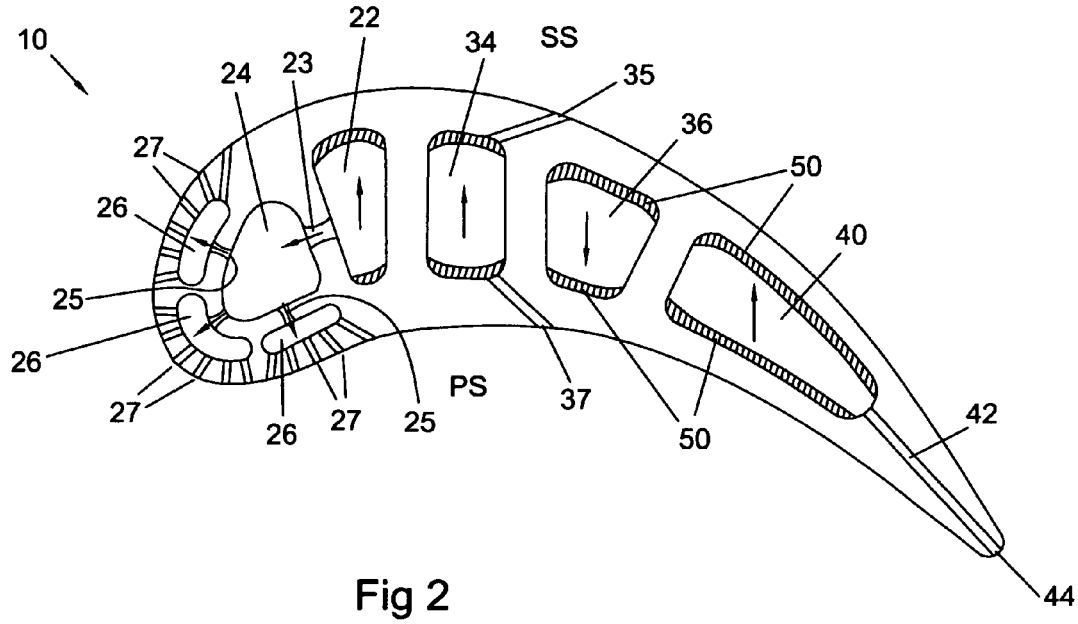
FIG. 2 shows a showerhead arrangement of the present invention.

The airfoil of the present invention is shown in FIG. 2 and includes the features described above with respect to the prior art FIG. 1 airfoil. In addition, FIG. 2 includes three multi-impingement cavities 26, one on the nose of the leading edge of the airfoil, a second one on the pressure side, and a third on the suction side of the airfoil. Multi-metering holes 25 connect the impingement cavity 24 to the multi-impingement and diffusion cavities 26. Each multi-impingement and diffusion cavity 26 includes a plurality of multi-showerhead holes 27 that open onto the respective surface of the airfoil to provide film cooling.

On the pressure side multi-impingement cavity 26, the downstream-most film cooling hole 27 discharges onto the pressure side surface at a location about where the forward-most side wall of the cooling supply cavity 22 ends. On the suction side multi-impingement cavity 26, the downstream-most film cooling hole 27 discharges onto the suction side surface at a location about where the closest point of the impingement cavity 24 is to the suction side wall of the airfoil as shown in FIG. 2.

The operation of the showerhead design of the present invention in FIG. 2 is described below. Cooling air is supplied from a source such as a compressor to the leading edge cooling supply cavity 22, passes though a plurality of the first metering holes 23 and into the impingement cavity 24. Cooling air flow through the first metering holes provides impingement cooling for the airfoil leading edge section. Cooling air then flows through the multi-metering holes 25 and into the respective multi-impingement cavity 26. This flow provides backside impingement cooling to the airfoil leading edge region at a much closer distance to the airfoil exterior hot surface. Cooling air is then discharged to the airfoil external surface through a plurality of film cooling holes 27 associated with the three multi-impingement cavities 26. In order to ensure adequate cooling to each portion of the leading edge region, the various metering holes and film cooling holes can be sized to direct the proper amount of cooling air to that particular portion of the airfoil.

The leading edge cooling supply channel 22 extends from the platform region of the airfoil up to the tip region. The impingement cavity 24 can be a single cavity extending from the platform to the tip region, or it can be formed of a plurality of individual cavities aligned with the cooling supply channel 22. Each individual impingement cavity 24 can be connected to the cooling supply channel 22 by one or more of the first metering holes 23.

The multi-impingement and diffusion cavities 26 can also be one long cavity extending along the leading edge of the airfoil, or be formed from a plurality of separate multi-impingement cavities aligned along the leading edge, each connected to the impingement cavity through one or more multi-metering holes 25.

I claim the following:

1. An airfoil for use in a turbine, the airfoil including a pressure side and a suction side, and a leading edge and a trailing edge, and a cooing air supply cavity within the airfoil to supply cooling air to the leading edge region of the airfoil, the airfoil comprising:

an impingement cavity located between the leading edge of the airfoil and the cooling air supply cavity;

at least one first metering hole to meter cooling air flow from the cooling supply cavity into the impingement cavity;

a plurality of multi-impingement cavities located between the impingement cavity and the leading edge surface of the airfoil;

at least one second metering hole associated with each of the multi-impingement cavities to meter cooling air flow from the impingement cavity into the respective multi-impingement cavity;

a plurality of film cooling holes associated with each of the multi-impingement cavities to discharge cooling air to the leading edge surface of the airfoil; and, the plurality of multi-impingement cavities comprises a first multi-impingement cavity located at the nose of the leading edge region of the airfoil, a second multi-impingement cavity located adjacent to the first multi-impingement cavity and on the pressure side thereof, and a third multi-impingement cavity located adjacent to the first multi-impingement cavity and on the suction side thereof.

2. The airfoil of claim 1, and further comprising:

the film cooling holes from the multi-impingement cavities are substantially evenly spaced along the leading edge surface of the airfoil.

3. The airfoil of claim 1, and further comprising:

a cross sectional area of the plurality of multi-impingement cavities is about equal to the cross sectional area of the impingement cavity.

4. An airfoil for use in a turbine, the airfoil including a pressure side and a suction side, and a leading edge and a trailing edge, and a cooing air supply cavity within the airfoil to supply cooling air to the leading edge region of the airfoil, the airfoil comprising:

an impingement cavity located between the leading edge of the airfoil and the cooling air supply cavity;

at least one first metering hole to meter cooling air flow from the cooling supply cavity into the impingement cavity;

a plurality of multi-impingement cavities located between the impingement cavity and the leading edge surface of the airfoil;

at least one second metering hole associated with each of the multi-impingement cavities to meter cooling air flow from the impingement cavity into the respective multi-impingement cavity;

a plurality of film cooling holes associated with each of the multi-impingement cavities to discharge cooling air to the leading edge surface of the airfoil;

The impingement cavity is formed of a plurality of separate impingement cavities aligned with the cooling supply cavity; and, Each separate impingement cavity comprising at least one metering hole to meter cooling air from the cooling supply cavity into the respective impingement cavity.

5. An airfoil for use in a turbine, the airfoil including a pressure side and a suction side, and a leading edge and a trailing edge, and a cooing air supply cavity within the airfoil to supply cooling air to the leading edge region of the airfoil, the airfoil comprising:

an impingement cavity located between the leading edge of the airfoil and the cooling air supply cavity;

at least one first metering hole to meter cooling air flow from the cooling supply cavity into the impingement cavity;

a plurality of multi-impingement cavities located between the impingement cavity and the leading edge surface of the airfoil;

at least one second metering hole associated with each of the multi-impingement cavities to meter cooling air flow from the impingement cavity into the respective multi-impingement cavity;

a plurality of film cooling holes associated with each of the multi-impingement cavities to discharge cooling air to the leading edge surface of the airfoil;

each of the plurality of multi-impingement cavities is formed of a plurality of separate multi-impingement cavities aligned with the leading edge of the airfoil; and, each of the separate multi-impingement cavities comprising at least one multi-metering hole to meter cooling air from the impingement cavity into the respective separate multi-impingement cavity.

6. A process for cooling a leading edge of an airfoil used in a gas turbine engine, the airfoil having an internal cooling supply passage for supplying cooling air to the leading edge, the process including the steps of:

supplying cooling air to the cooling supply cavity of the airfoil;

metering cooling air from the cooling supply cavity into a first impingement cavity located between the cooling supply cavity and the leading edge;

metering the cooling air from the impingement cavity into a second impingement cavity located between the first impingement cavity and the leading edge;

discharging the cooling air from the second impingement cavity through a plurality of film cooling holes onto the leading edge surface of the airfoil; and, the step of metering the cooling air from the impingement cavity into a second impingement cavity comprises metering the cooling air into a plurality of second impingement cavities located between the first impingement cavity and the leading edge.

* * * * *